US007279086B2

(12) United States Patent
Morrissey

(10) Patent No.: US 7,279,086 B2
(45) Date of Patent: Oct. 9, 2007

(54) ELECTROPLATING SOLUTION FOR ALLOYS OF GOLD WITH TIN

(75) Inventor: Ronald J. Morrissey, Cranston, RI (US)

(73) Assignee: Technic, Inc., Cranston, RI (US)

( * ) Notice: Subject to any disclaimer, the term of this patent is extended or adjusted under 35 U.S.C. 154(b) by 140 days.

(21) Appl. No.: 10/847,468

(22) Filed: May 18, 2004

(65) Prior Publication Data

US 2004/0231999 A1 Nov. 25, 2004

Related U.S. Application Data

(60) Provisional application No. 60/472,826, filed on May 21, 2003.

(51) Int. Cl.
*C25D 3/62* (2006.01)
*C25D 3/60* (2006.01)

(52) U.S. Cl. ..... 205/247; 205/251; 205/253

(58) Field of Classification Search ..... 205/247, 205/251, 253

See application file for complete search history.

(56) References Cited

U.S. PATENT DOCUMENTS 4,168,214 A 9/1979 Fletcher et al. ..... 204/43 G
4,470,886 A 9/1984 Duva et al. ..... 204/43 G
4,767,507 A 8/1988 Wilkinson ..... 204/44.3
6,245,208 B1 * 6/2001 Ivey et al. ..... 205/248

FOREIGN PATENT DOCUMENTS

GB 1 065 308 4/1967
JP 2002-180259 6/2002
JP 2002180259 A * 6/2002

* cited by examiner

*Primary Examiner*—Edna Wong
(74) *Attorney, Agent, or Firm*—Winston & Strawn LLP

(57) ABSTRACT

The invention relates to an electroplating solution for providing a deposit of an alloy of gold and tin. This solution includes an aqueous solvent in which gold is present in the form of a solution soluble cyanide complex and tin is present in the form of a solution soluble organotin complex. 2,2'-dipyridyl is present as an additive that allows the codeposition of useful gold-tin alloy compositions at current densities lower than would be possible in its absence, given the concentrations of the individual metallic components in the solution. This additive is generally used at a concentration of 0.1 to 1 grams per liter for imparting significant enhancements in providing gold-tin alloy deposits.

19 Claims, No Drawings

ELECTROPLATING SOLUTION FOR ALLOYS OF GOLD WITH TIN

This application claims the benefit of U.S. provisional application 60/472,826 filed May 21, 2003, and the entire content of which is expressly incorporated herein by reference thereto.

BACKGROUND ART

The present invention relates to an electroplating solution that can more efficiently and effectively deposit gold tin alloys, and to methods for providing such deposits.

Alloys of gold and tin, particularly in the compositional range of about 75 to 80 percent gold by weight, are useful as solders for the interconnection of electronic components. While gold-tin alloy solder materials are available as thermally processed performs, it is generally acknowledged that the ability to electroplate such materials allows the flexibility to deposit overall or in selected areas at will, and to adjust deposit thicknesses as required. For these reasons, much effort has been made to develop workable electroplating systems for these alloys, and numerous references are provided in the literature about such systems.

For many years, the trend in electronic device fabrication has been toward increasingly larger arrays and increasing complexity of such arrays. In practical electroplating terms, this means that at a given overall average current density, the local current density at the individual features of a component part in the array may deviate significantly from the average. Since in alloy plating systems the composition of the deposit is usually a function of current density, such deviations tend to limit the ability of the electroplating solution to deposit homogeneous films over large and complex arrays. For this reason, actual current densities employed in the fabrication of complex arrays tend to be rather low, and generally on the order of about 2-5 amperes per square foot.

It would be desirable to obtain electroplating solutions that are capable of depositing gold-tin alloy deposits as homogeneous films over current complex arrays. Accordingly, improved electroplating solutions are now provided by the present invention.

SUMMARY OF THE INVENTION

The invention relates to an electroplating solution for providing a deposit of an alloy of gold and tin. This solution advantageously comprises gold in the form of a solution soluble cyanide complex, tin in the form of a solution soluble organotin complex; and an aqueous solvent. According to the invention, 2,2'-dipyridyl is present as an additive that allows the codeposition of useful gold-tin alloy compositions at current densities lower than would be possible in its absence, given the concentrations of the individual metallic components in the solution. This additive is generally used at a concentration of 0.1 to 1 grams per liter for imparting significant enhancements in providing gold-tin alloy deposits.

The electroplating solution typically includes the gold complex as monovalent gold cyanide or trivalent gold cyanide. Also, the organotin complex is preferably stannous citrate, stannous oxalate, or stannous iminodiacetate, and can be formed either pre-manufactured as the desired complex or in situ by addition of a stannous salt and a tin-complexing organic ligand.

Useful aqueous solvents for these solutions are aqueous solutions of organic acids. In particular, citric acid and citrates are preferred since these chemicals form desirable complexes with the metals that are to be deposited.

If desired, various additives can be included to impart further benefits to the solution. For example, one or more of thallous, plumbous or arsenious ions can be added in an amount effective to provide grain refinement to the deposit. Also, other additives, such as surfactants or wetting agents, brighteners, leveling agents, etc., can be used for their known purposes.

The invention also relates to a process for the codeposition of useful gold-tin alloy compositions. An additive of 2,2'-dipyridyl is present in the electroplating solutions of the invention in an amount that allows codeposition to occur at current densities lower than would be possible in its absence, given the concentrations of the individual metallic components in the solution. This additive is generally used at a concentration of 0.1 to 1 grams per liter as noted above, and an alloy deposit of gold and tin is provided on the metallic portions of a substrate by electroplating from one of the solutions disclosed herein.

DETAILED DESCRIPTION OF THE PREFERRED EMBODIMENTS

These electroplating solutions of the invention are capable of operating over a wide and useful range of current densities, and are capable of depositing alloys the appearance of which, as well as the composition, is as uniform as possible over the useful range of current densities. In these solutions, the deposition potentials of gold and tin are closer to each other in the presence of the dipyridyl additive than in its absence.

In the most preferred solutions, gold is contained in the form of a soluble cyanide complex, and tin in the form of a complex of stannous ion with a suitable organic ligand.

In the interest of compatibility with photoresists used to define circuit patterns, an operating pH in the range of about 3.5 to 4 was found to be most advantageous. For other substrates, the pH can range from between about 3 and 5. The invention also works with auric gold in the pH range of about 3 to 4, with aurous gold forming spontaneously in the system. As noted above, commonly available organic acid electrolytes, such as those based on citrates, are highly soluble and well buffered in this pH range and are desirable for this reason.

Stannous ion is known to be complexed by various organic ligands. In the electrolytes of this invention, citrates, oxalates, and iminodiacetates were all investigated and found to be suitable. For this invention, citrate is the ligand of choice, both for stability and for compatibility with the electrolyte system.

In view of this, the bath matrix or electrolyte preferred for the present invention employs citric acid and/or salts thereof. Other organic acids, such as formic acid, lactic acid, malic acid, succinic acid, gluconic acid, glycolic acid, or combinations thereof may also be utilized in concentrations ranging from about 75 to 300 g/l, and preferably from about 100 to 200 g/l.

In order to obtain homogeneous alloy deposits, it is important that the deposition potentials of the individual alloy components in the electrolyte of interest be as close to each other as possible (See, e.g., A. Brenner, Electrodeposition of Alloys, Volume I, Academic Press, New York, 1963, p. 46). If the individual deposition potentials in the absence of additives are not of themselves close, it is sometimes possible to devise or discover an addition agent or agents which can facilitate the alloy deposition process. The present invention is based upon the latter feature, in that a family of suitable agents has been discovered for electroplating gold-tin alloy deposits on suitable metal substrates or on substrates that have metallic portions.

The preferred additive to obtain this benefit is 2,2'-dipyridyl added to the solution so that it is present at a concentration of about 0.1 to 1 grams per liter. As noted above, this additive allows the codeposition of useful gold-tin alloy compositions at current densities lower than would be possible in its absence, given the concentrations of the individual metallic components in the solution.

The Examples show this enhancement. The examples also show that the composition of alloy deposits plated from the solutions without the additive are not a linear function of current density. It will also be shown that the addition of a small quantity of the additive, e.g., 2,2'-dipyridyl, provides a linear variation, and also expands the range of current densities over which homogeneous alloys can be deposited. It will be also be shown that additions of small quantities of thallium, lead, or arsenic in addition to the dipyridyl compound are helpful in obtaining alloy deposits of highly uniform appearance.

The gold-tin deposits generally contain between 60 and 95% gold and preferably between 75 and 85%, with the balance being essentially tin. Trace amounts of other elements may be present even though not intentionally added.

The gold-tin plating processes of the present invention are eminently suitable for plating gold-tin alloys on wafers and printed circuit boards. As these components grow larger and more complex, the better control of gold-tin alloy codeposition is necessary for obtaining improved results. Today, twelve-inch wafers are in use and deep-tank boards are 24 by 30 inches or larger. The present process provides a practical approach to obtaining uniform deposits over really large arrays by allowing codeposition at quite low current densities and in different types of plating systems.

EXAMPLES

Illustrative embodiments of the invention are provided in the following examples.

Example 1

Sufficient water was employed to form one litter of a solution containing the following:

| | |
|---|---|
| 75 grams | tripotassium citrate |
| 105 grams | citric acid |
| 6.5 grams | tin metal in the form of stannous citrate |
| 9 grams | gold as potassium aurocyanide |

The pH as made up was 3.8 A 267 ml aliquot of this solution was plated in a Hull cell at 0.5 ampere for 5 minutes at 120° F. with moving-vane agitation. The deposit as plated showed a bright grayish-yellow (gold-rich) region extending about halfway across the panel (to about 6 amperes per square foot indicated) from the low current density edge. At current densities above 6 amperes per square foot, a gray matte (tin-rich) area that extended to the high current density edge was observed. Readings of the deposit composition were obtained by energy-dispersive x-ray analysis using a scanning electron microscope (SEM/EDX) over a range from 3 to 7.5 amperes per square foot indicated, with results as follows:

| Current Density amps/square foot | Percent Gold |
|---|---|
| 3 | 93.34 |
| 4 | 89.62 |
| 5 | 89.56 |
| 6 | 89.49 |
| 7.5 | 81.98 |

Example 2

The solution of Example 1 was repeated, except that it additionally contained about 0.16 grams of 2,2'-dipyridyl. The solution gradually turned pink in color. A test panel was plated from this solution in a Hull cell under conditions identical to those cited in Example 1. In this case, the transition from yellowish to grayish color of the deposit occurred at about 3 amperes per square foot, and the transition in color was less abrupt than was noted in Example 1. The deposit was analyzed by SEM/EDX as described previously, with results as follows:

| Current Density amps/square foot | Percent Gold |
|---|---|
| 3 | 83.91 |
| 4 | 75.77 |
| 5 | 69.07 |
| 6 | 65.42 |
| 7.5 | 62.58 |

Compared to Example 1, the tin content of the deposits had been increased overall, and the discharge potential of tin has been displaced closer to that of gold.

Example 3

Comparative

A solution was made up as in Example 1, except that the tin was added in the form of stannous oxalate. A test panel was plated from this solution in a Hull cell with moving-vane agitation at 0.5 ampere for 5 minutes at 110° F., yielding a deposit showing a bright grayish-yellow (gold-rich) region extending somewhat more than halfway across the panel (to about 10 amperes per square foot indicated) from the low current density edge. At current densities above 10 amperes per square foot, a gray matte (tin-rich) area extended to the high current density edge was observed. SEM/EDX analysis of the deposit over the range of 3-7.5 amperes per square foot indicated gave results as follows:

| Current Density Amps/square foot | Percent Gold |
|---|---|
| 3 | 93.55 |
| 4 | 93.56 |
| 5 | 92.43 |
| 6 | 91.38 |
| 7.5 | 90.99 |

Example 4

An electroplating solution was made up identically to that of Example 3, except additionally containing about 0.16 grams of 2,2'-dipyridyl. A test panel was plated in a Hull cell from this solution under identical conditions to those of Example 3. The deposit obtained in this experiment showed a bright grayish-yellow region extending to about 3 amperes per square foot indicated from the low current density edge. Above 3 amperes per square foot a bright gray ring extended to about 5 amperes per square foot, and above that a matte gray area extended to the high current density edge. SEM/EDX analysis of the deposit over the range from 3 to 7.5 amperes per square foot indicated gave results as follows:

| Current Density amps/square foot | Percent Gold |
|---|---|
| 3 | 90.56 |
| 4 | 85.74 |
| 5 | 76.03 |
| 6 | 73.30 |
| 7.5 | 67.95 |

Again, addition of 2,2'-dipyridyl has increased the overall tin content of the deposits, and displaced the deposition potential of tin closer to that of gold.

Example 5

Comparative

An electroplating solution was made up as in Example 1, except that only 3 grams of tin were added, in the form of stannous iminodiacetate. A test panel was plated from this solution in a Hull cell with moving-vane agitation at 0.5 ampere for 5 minutes at 130° F. The resulting deposit showed a bright grayish-yellow (gold-rich) region extending from the low current density edge to about 7.5 amperes per square foot indicated. Above 7.5 amperes per square foot a matte gray (tin-rich) region extended to about 17.5 amperes per square foot, above which a semi-bright grayish region extended up to the high current density edge. SEM/EDX measurements were obtained from this deposit over the current density range from about 3 to 7.5 amperes per square foot indicated, with results as follows:

| Current Density Amps per square foot | Percent Gold |
|---|---|
| 3 | 92.59 |
| 4 | 91.85 |
| 5 | 91.20 |
| 6 | 91.30 |
| 7.5 | 90.94 |

Example 6

An electroplating solution was made up as in Example 5 except additionally containing about 0.16 grams of 2,2'-dipyridyl. A test panel was plated from this solution in a Hull cell with moving-vane agitation at 0.5 ampere for 5 minutes at 130° F. The deposit produced exhibited a bright grayish-yellow (gold-rich) region to about 3 amperes per square foot indicated. Above 3 amperes per square foot, a dull-to-smooth matte gray region extended up to about 20 amperes per square foot, above which the deposit was burnt. SEM/EDX measurements were obtained over the current density range from about 3 to 7.5 amperes per square foot with results as follows:

| Current Density Amps per square foot | Percent Gold |
|---|---|
| 3 | 88.36 |
| 4 | 79.71 |
| 5 | 73.30 |
| 6 | 70.38 |
| 7.5 | 65.40 |

The pattern of the previous Examples is thus repeated. Addition of 2,2'-dipyridyl increases the tin content of the deposits in the working range and displaces the deposition potential of tin closer to that of gold.

In general, raising the temperature of the plating solutions of this invention tends to increase the gold content of the deposits. Increasing current density tends to increase the tin content. Given this degree of control, which has been demonstrated with three separate organotin complexes, it will be apparent to those skilled in the art that other organotin complexes can also be employed for the purposes of this invention. It will also be apparent that it is possible to incorporate a suitable ligand into the electrolyte, so that by addition of a suitable stannous salt, an organotin species is formed in situ.

In the Examples listed thus far, gold has been added in the form of the monovalent cyanide. At pH values below approximately 4, it is also possible to employ gold in the form of the trivalent cyanide for the purpose of obtaining alloy deposits of gold and tin, as shown in the following Example.

Example 7

An electroplating solution was made up as in Example 2, except that the gold was introduced in the form of potassium auricyanide, $KAu(CN)_4$. Coupon samples were plated from this solution at 100° F., with results as follows:

| Current Density Amps per square foot | Percent Gold |
|---|---|
| 5 | 77.05 |
| 7.5 | 76.06 |
| 10 | 76.34 |
| 12.5 | 73.19 |

In Examples 2, 4, 6, and 7, 2,2'-dipyridyl was employed at a concentration of about 0.16 grams per liter, which is sufficient to accomplish the purposes of the invention. It is obviously useful to establish a range of useful concentration as the following Example attempts to do.

Example 8

An electroplating solution was formed as in Example 1. Aliquot portions of this solution were plated separately in a Hull cell with moving-vane agitation at 0.5 ampere for 5 minutes at 120° F. with additions of 2,2'-dipyridyl of 0.16, 0.32, and 0.80 grams per liter. The resulting set of test panels were of essentially identical appearance. On the basis of these experiments, a useful range of concentration of 2,2'-dipyridyl for the purpose of this invention is estimated to be from about 0.1 to 1.0 gram per liter.

In Examples 2, 4, 6, 7, and 8, the deposits obtained containing gold in the range of about 70-80 percent by weight are generally of a matte to semi-matte gray appearance. It is possible to obtain a slight, but noticeable brightening of the deposit surface by adding to the electroplating solution effective amounts of certain metals known to exert a grain-refining effect on deposits of pure gold. The net effect of such additions is to provide a more uniform appearance to gold-tin alloy electrodeposits on substrates of complex geometry and/or large size. Some Examples of such additives are as follows:

Example 9

An electroplating solution was made up as in Example 2, except additionally containing about 100 parts per million thallium, added as thallous sulfate. A test panel was plated from this solution in a Hull cell with moving-vane agitation for 5 minutes at 0.5 ampere at 120° F. The test panel obtained was of an appearance similar to that obtained in Example 2, but having somewhat higher luster and greater uniformity.

Example 10

An electroplating solution was made up as in Example 2, except additionally containing about 100 parts per million lead, added as plumbous acetate. A test panel was plated from this solution in a Hull cell with moving-vane agitation for 5 minutes at 0.5 ampere at 120° F. The test panel obtained was of an appearance similar to that obtained in Example 2, but having somewhat higher luster and greater uniformity.

Example 11

An electroplating solution was made up as in Example 2, except additionally containing about 30 parts per million arsenic, added as sodium arsenite. A test panel was plated from this solution in a Hull cell with moving-vane agitation for 5 minutes at 0.5 ampere at 120° F. The test panel obtained was of an appearance similar to that obtained in Example 2, but having somewhat higher luster and greater uniformity.

It will be apparent to those skilled in the art that Hull cell experiments as referred to in these Examples are subject to variations introduced by the concentrations of the various components, as well as the uniformity of temperature control and consistency of agitation. In general, effective concentration ranges of the various additives cited may be considered to be of the order of ±50 percent of the values cited. Specific experiments involving 2,2'-dipyridyl were cited in Example 8.

What is claimed is:

1. A method for optimizing a range of useful current densities for electroplating of a gold-tin alloy deposit from an electroplating solution, which comprises:

formulating the electroplating solution to consist of an aqueous solvent, a concentration of gold in the solution in the form of a solution soluble cyanide complex, a concentration of tin in the solution in the form of a solution soluble organotin complex; and as a sole alloy deposition agent in the solution 2,2'-dipyridyl at a concentration effective to allow codeposition of the gold and tin upon a suitable substrate in a gold-tin alloy deposit containing between 60 and 95% gold with the balance being essentially tin, and optionally with a grain refining agent; and electroplating the gold-tin alloy deposit from the solution and onto the suitable substrate at a current density that is lower than would be possible in the absence of the 2,2'-dipyridyl, given the concentrations of the gold and tin in the solution.

2. The method of claim 1, wherein the 2,2'-dipyridyl is present at a concentration of 0.1 to 1 grams per liter.

3. The method of claim 1, wherein the gold-tin alloy deposit generally contains between 75 and 85% gold with the balance being essentially tin.

4. The method of claim 1, wherein the solution has a pH of between 3 and 5.

5. The method of claim 1, wherein the gold complex is monovalent gold cyanide or trivalent gold cyanide.

6. The method of claim 1, wherein the organotin complex is stannous citrate, stannous oxalate, or stannous iminodiacetate.

7. The method of claim 1, wherein the organotin complex is formed in situ by addition of a stannous salt and a tin-complexing organic ligand.

8. The method of claim 1, wherein the grain refining agent is present in the electroplating solution in the form of one or more of thallous, plumbous or arsenious ions in an amount effective to provide grain refinement to the gold-tin alloy deposit.

9. The method of claim 1, wherein the solvent is an aqueous solution of an organic acid.

10. The method of claim 9, wherein the organic acid is formic, citric, lactic, malic, succinic, gluconic, or glycolic acid or combinations thereof.

11. The method of claim 10, wherein the organic acid or combination is present in a concentration of about 75 to 300 g/l.

12. A method for optimizing a range of useful current densities for electroplating of a gold-tin alloy deposit from an electroplating solution, which comprises:

formulating the electroplating solution to consist of an aqueous solvent, a concentration of gold in the solution in the form of a solution soluble cyanide complex, a concentration of tin in the solution in the form of a solution soluble organotin complex; and as a sole alloy deposition agent in the solution 2,2'-dipyridyl at a concentration at a concentration of 0.1 to 1 grams per liter to allow codeposition of the gold and tin upon a suitable substrate in a gold-tin alloy deposit containing between 75 and 85% gold with the balance being essentially tin, with the solution having a pH of between 3 and 5, and optionally with a grain refining agent; and electroplating the gold-tin alloy deposit from the solution and onto the suitable substrate at a current density that is lower than would be possible in the absence of the 2,2'-dipyridyl, given the concentrations of the gold and tin in the solution.

13. The method of claim 12, wherein the gold complex is monovalent gold cyanide or trivalent gold cyanide.

14. The method of claim 12, wherein the organotin complex is stannous citrate, stannous oxalate, or stannous iminodiacetate.

15. The method of claim 12, wherein the organotin complex is formed in situ by addition of a stannous salt and a tin-complexing organic ligand.

16. The method of claim 12, wherein the grain refining agent is present in the electroplating solution in the form of one or more of thallous, plumbous or arsenious ions in an amount effective to provide grain refinement to the gold-tin alloy deposit.

17. The method of claim 12, wherein the solvent is an aqueous solution of an organic acid.

18. The method of claim 17, wherein the organic acid is formic, citric, lactic, malic, succinic, gluconic, or glycolic acid or combinations thereof.

19. The method of claim 18, wherein the organic acid or combination is present in a concentration of about 75 to 300 g/l.

* * * * *